US006305582B1

(12) United States Patent
Tsutsui et al.

(10) Patent No.: US 6,305,582 B1
(45) Date of Patent: Oct. 23, 2001

(54) INHALER AND VALVE THEREFOR

(75) Inventors: Tatsuo Tsutsui, Kanagawa; Akira Yanagawa, Yokohama, both of (JP)

(73) Assignees: Unisia Jecs Corporation, Atsugi; Dott Limited Company, Yokohama, both of (JP)

( * ) Notice: Subject to any disclaimer, the term of this patent is extended or adjusted under 35 U.S.C. 154(b) by 0 days.

(21) Appl. No.: 09/402,883

(22) PCT Filed: Mar. 19, 1999

(86) PCT No.: PCT/JP99/01386

§ 371 Date: Oct. 14, 1999

§ 102(e) Date: Oct. 14, 1999

(87) PCT Pub. No.: WO99/48774

PCT Pub. Date: Sep. 30, 1999

(30) Foreign Application Priority Data

Mar. 20, 1998 (JP) ..... 10-71083

(51) Int. Cl.[7] ..... B65D 83/00
(52) U.S. Cl. ..... 222/402.24; 222/402.25
(58) Field of Search ..... 222/402.1, 402.24, 222/402.25, 635

(56) References Cited

U.S. PATENT DOCUMENTS

| | | | | |
|---|---|---|---|---|
| 2,686,652 | | 8/1954 | Carlson et al. | 251/353 |
| 3,796,352 | * | 3/1974 | Morane | 222/402.24 |
| 4,442,959 | | 4/1984 | Del Bon et al. | 222/402.24 |
| 4,875,605 | * | 10/1989 | Weston | 222/402.24 |
| 5,392,959 | * | 2/1995 | Tubaki et al. | 222/402.24 |

FOREIGN PATENT DOCUMENTS

| | | |
|---|---|---|
| 26 23 263 | 12/1977 | (DE) . |
| 720 250 | 12/1954 | (GB) . |

OTHER PUBLICATIONS

Patent Abstracts of Japan, vol. 96 No. 10 (Oct. 1996), "Method of Fixing Jetted Particle Diameter on Quantitative Jetting of Jetting Fluid Using Liquefied High Pressure Gas as Propellent, Quantitative Jetting Valve and Jetting Nozzle and Jetting Device Using Same", Abstract of Fumino Ichiro, JP 08 141450, (Jun. 4, 1996).

* cited by examiner

*Primary Examiner*—Joseph A. Kaufman
(74) *Attorney, Agent, or Firm*—Foley & Lardner

(57) ABSTRACT

A valve and an inhalator with the valve are disclosed. A valve case is secured to a container storing pressurized fluid. A valve pin is moveably mounted to the valve case. First and second seals are arranged in a spaced relation in an axial direction of the valve pin. The first seal is mounted onto a piston portion of the valve pin that is received in the valve case and exposed to the pressurized fluid. The valve pin is formed with a fluid passage having an outlet communicating with the outside of the container and an inlet communicating with a space between the piston portion and the valve case and arranged between the seals in a spaced relation. The valve pin takes a first position where the first seal cooperates with the valve case to block fluid communication between the inside and the outside of the container through the space and the fluid passage and a second position where the first seal cooperates with the valve case to establish the fluid communication between the inside and the outside of the container therethrough.

16 Claims, 2 Drawing Sheets

INHALER AND VALVE THEREFOR

TECHNICAL FIELD

The present invention relates to a valve for use in an inhalator for aerosolizing a fluid stored in a container by using high pressure gas, for example, liquefied carbon dioxide ($CO_2$ ) gas, as propellants, and more particularly to an improved valve adapted for restraining excessive increase in pressure within the container.

BACKGROUND ART

There is known apparatus adapted for aerosolizing a fluid such as medicine, that is stored in a container along with high pressure gas as propellant, through a valve fixed to an inlet of the container. The apparatus of this type has conventionally utilized a specific fluorocarbon (flon) as propellant. At present, the apparatus tends to use hydrofluorocarbon HFC134*a* as an alternative of the specific flon with increasing concern about environmental protection. However, HFC134*a* influences not ozonosphere but global warming not less than one thousand times the degree caused by $CO_2$. Thus, if HFC134*a* is used with great frequency, it seems that serious environmental problem occurs. Accordingly, use of $CO_2$ gas or inert gases, for instance, nitrogen, helium, neon, krypton, xenon and radon, acting as aerosol propellant, is at present proposed.

In the case of using such gases as propellant, it is required to liquefy or compress the gases for reducing a size of container as well as the flon conventionally used. The liquefied gases have a high vapor pressure. For example, liquefied $CO_2$ gas has vapor pressure of 60 kgf/cm$^2$ at 20° C. It is also desirable that inert gases are liquefied or compressed under pressure of not less than 50 kgf/cm$^2$ in order to increase volumetric efficiency thereof. Japanese Patent Application First Publication No. 8-141450 discloses an aerosol using such liquefied gas.

The liquefied gas as propellant to be filled in the container has high vapor pressure as described above. The vapor pressure within the container tends to rapidly increase in response to even slight temperature rise of the ambient atmosphere. Therefore, such the aerosol must be handled with considerable care.

The above-described conventional art discloses a gas-emitting valve and an aerosol with the gas-emitting valve, including a gas cartridge that stores fluid and liquefied $CO_2$ gas as propellant. The gas-emitting valve is secured to an open end of the gas cartridge. The valve includes a valve case having a guide bore and a valve pin moveably mounted to the valve case through the guide bore. The valve pin includes a large-diameter portion substantially disposed within the valve case and a small-diameter portion that is connected with the large-diameter portion and projects outward from the valve case. The valve case and the valve pin cooperate with the open end of the cartridge to define a gas passage for the fluid and liquefied $CO_2$ gas flowing from inside of the cartridge to outside thereof. The gas passage includes an annular space between the large-diameter portion of the valve pin and an inner periphery of the valve case that defines the guide bore. A seal ring is fixed onto the valve case so as to project into the gas passage and interrupt the gas passage. When one end of the valve pin is in a non-depressed position, the large-diameter portion of the valve pin is in contact with the seal ring to thereby block the flow of gas passing through the gas passage. When the one end of the valve pin is depressed, the large-diameter portion of the valve pin is moved inward the cartridge to be free from the contact with the seal ring and a clearance is generated between the small-diameter portion of the valve pin and the seal ring. Thus, the flow of the fluid and liquefied $CO_2$ gas is discharged and sprayed from the cartridge through the clearance that forms a part of the gas passage. An amount of the flow to be discharged per unit time is adjusted by determining the annular space between the valve pin and the valve case.

In the conventional art, the amount of the flow to be discharged from the cartridge per unit time is determined by a size of the annular space that is in the order of 0.01 mm. Namely, the size of the annular space is a size as small as those represented by a unit of 0.01 mm. If there is a slight error in the formation of the annular space, then the slight error will cause considerable dispersion of the amount of the flow to be discharged per unit time every valve and aerosol as a completed product. Further, the amount of the flow to be discharged will be reduced due to clogging of the annular space with the fluid upon stopping the discharge of the flow. This leads to unstable discharge of the flow from the cartridge.

It is an object of the present invention to provide a valve and an inhalator with the valve, capable of stably discharging a flow of fluid and pressurized gas as propellant that are stored in a container of the inhalator.

DISCLOSURE OF INVENTION

According to one aspect of the present invention, there is provided a valve for an inhalator including a container storing a pressurized fluid, comprising:

a valve case secured to the container;

a valve pin moveably mounted to said valve case, said valve pin including an end portion that is exposed to the pressurized fluid within the container, said end portion of said valve pin cooperating with said valve case to define a space therebetween;

a first seal and a second seal that are arranged in a spaced relation in an axial direction of said valve pin, said first seal being mounted onto said end portion of said valve pin; and a fluid passage formed in said valve pin, said fluid passage having an outlet communicating with outside of the container and an inlet that communicates with said space and is arranged between said first and second seals in a spaced relation thereto;

said valve pin taking a first position where said first seal cooperates with said valve case to block fluid communication between inside and outside of the container through said space and said fluid passage and a second position where said first seal cooperates with said valve case to establish the fluid communication between inside and outside of the container through said space and said fluid passage.

According to a further aspect of the present invention, there is provided an inhalator, comprising:

a container having an open end and a pressurized fluid;

a valve case secured to said open end of said container;

a valve pin moveably mounted to said valve case, said valve pin including an end portion that is exposed to said pressurized container within said container, said end portion of said valve pin cooperating with said valve case to define a space therebetween;

a first seal and a second seal that are arranged in a spaced relation in an axial direction of said valve pin, said first seal being mounted onto said end portion of said valve pin; and a fluid passage formed in said valve pin, said fluid passage having an outlet communicating with outside of said container and an inlet that communicates with said space and is arranged between said first and second seals in a spaced relation thereto;

said valve pin taking a first position where said first seal cooperates with said valve case to block fluid communication between inside and outside of said container through said space and said fluid passage and a second position where said first seal cooperates with said valve case to establish the fluid communication between inside and outside of said container through said space and said fluid passage.

BEST MODE FOR CARRYING OUT THE INVENTION

Figure 1:
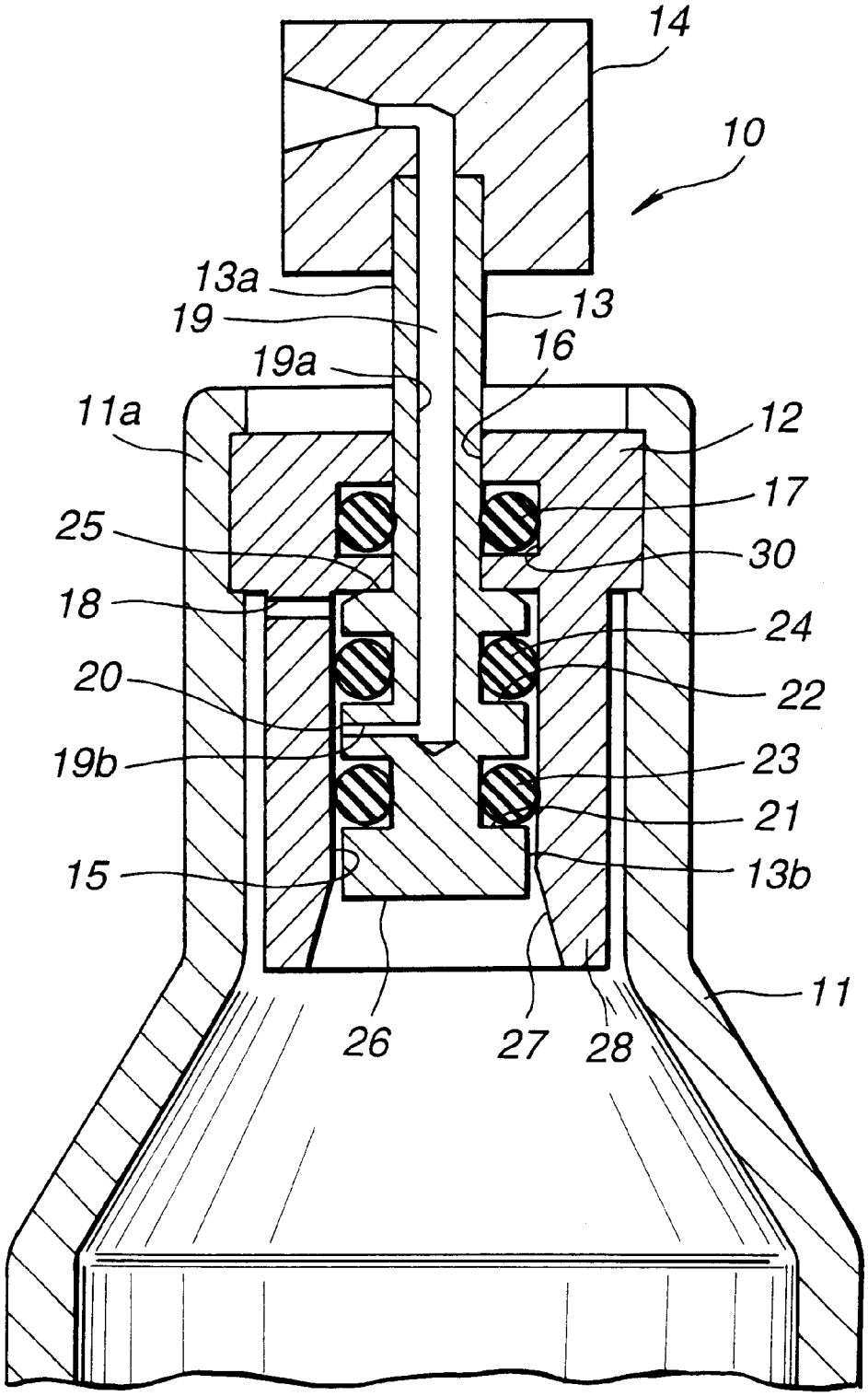
FIG. 1 is a section of a valve and an inhalator of a first embodiment according to the present invention.
Figure 2:
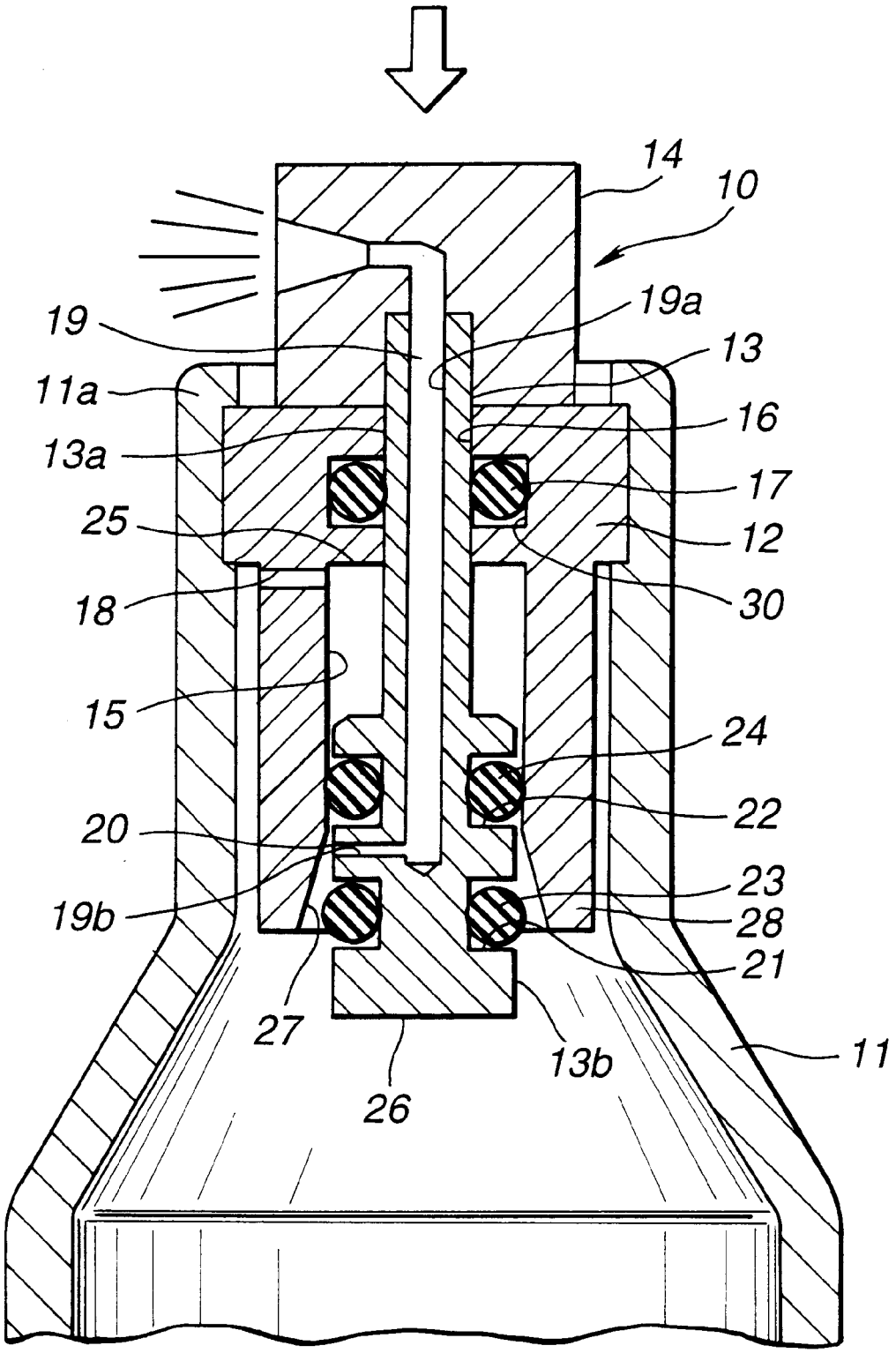
FIG. 2 is a view similar to FIG. 1, but showing the valve placed in a position different from a position of FIG. 1.

Referring now to FIGS. 1 to 2, a valve 10 and an inhalator into which the valve 10 is incorporated, according to the present invention, are explained.

As illustrated in FIG. 1, the inhalator includes a container 11 having an open end 11*a* open to the atmosphere. The container 11 receives a fluid such as medicine, and pressurized gas acting as propellant, for instance, liquefied carbon dioxide ($CO_2$) gas or the like. The valve 10 is hermetically mounted to the open end 11*a* of the container 11. The valve 10 includes a valve case 12 secured to the open end 11*a* of the container 11 and a valve pin 13 axially moveably mounted to the valve case 12. Specifically, the valve case 12 is fitted into the open end 11*a* of the container 11 and caulked thereat. The valve pin 13 extends through the valve case 12 and has one axial end, a lower end as viewed in FIG. 1, projecting into the valve case 12 and an opposite axial end, an upper end as viewed in FIG. 1, projecting outward from the valve case 12. A nozzle button 14 acting as a nozzle and a pushbutton is fixed to the upper end of the valve pin 13. The nozzle button 14 has a passage feeding the fluid entrained on the pressurized gas (the mixture is hereinafter referred to as merely "pressurized fluid") from the container 11 through a fluid passage 19 explained later, of the valve pin 13. The nozzle button 14 also has an aerosolizing outlet communicating with the passage, through which the pressurized fluid is aerosolized.

The valve case 12 includes a wall defining a central bore 15 of a generally cylindrical shape, that is open to inside, a lower side as viewed in FIG. 1, of the container 11. The wall of the valve case 12 includes a cylindrical side wall portion defining a circumferential periphery of the central bore 15 and a bottom wall portion that is joined with the side wall portion and defines a bottom of the central bore 15. The bottom wall portion also defines a guide bore 16 that is connected with the central bore 15 and arranged in substantially coaxial relation thereto. The guide bore 16 extends through the bottom wall portion and has a diameter smaller than the central bore 15. The side wall portion defines a pressure introducing passage 18 directly introducing vapor pressure within the container 11 into the bottom of the central bore 15. The pressure introducing passage 18 radially extends through the side wall portion near the bottom wall portion and communicates the central bore 15 with an annular space that is disposed between the side wall portion and the open end 11*a* of the container 11.

The valve pin 13 includes a shaft portion 13*a* and a piston portion 13*b* that is connected with the shaft portion 13*a* and has a diameter greater than a diameter of the shaft portion 13*a*. The shaft portion 13*a* is slidably fitted into the guide bore 16 of the valve case 12. The piston portion 13*b* is received in the central bore 15 of the valve case 12 and exposed to the pressurized fluid within the container 11. The piston portion 13*b* cooperates with the wall of the valve case 12 to define a space therebetween. Namely, the space exists between an outer peripheral surface of the piston portion 13*b* and an inner peripheral surface of the valve case 12 that surrounds the central bore 15.

A seal 17 of a ring shape is fitted to an annular groove 30 formed in the bottom wall portion of the wall of the valve case 12. The annular groove 30 is located at substantially the middle thereof in the axial direction of the guide bore 16. The seal 17 cooperates with the shaft portion 13*a* of the valve pin 13 to always block fluid communication between inside and outside of the container 11 through the space between the piston portion 13*b* and the valve case 12. The seal 17 is made of an elastic material.

Formed in the valve pin 13 is the fluid passage 19 for feeding the pressurized fluid within the container 11 to the outside thereof upon the nozzle button 14 being depressed. The fluid passage 19 has an outlet always communicating with outside of the container 11 and an inlet 20 always communicating with the space between the piston portion 13*b* and the valve case 12. Specifically, the fluid passage 19 includes an axial hole 19*a* extending from the upper end of the valve pin 13 toward the lower end thereof through inside of the shaft portion 13*a* in the axial direction. The axial hole 19*a* is open to an end face of the upper end of the valve pin 13. The fluid passage 19 also includes an orifice 19*b* that extends from a bottom of the axial hole 19*a* in a radial direction of the valve pin 13. The orifice 19*b* is open to the outer peripheral surface of the piston portion 13*b* and defines the inlet 20 of the fluid passage 19. The orifice 19*b* has a predetermined diameter smaller than a diameter of the axial hole 19*a* that is relatively large. The predetermined diameter of the orifice 19*b* is in the order of 0.1 mm as unit, namely, it is as large as represented by a unit of 0.1 mm. The orifice 19*b* determines an amount of flow of the pressurized fluid to be discharged or aerosolized per unit time. A diameter of the orifice 19*b* is suitably determined depending on a required amount of the flow of the pressurized fluid to be discharged per unit time. The fluid passage 19 then communicates with the passage of the nozzle button 14.

The piston portion 13*b* of the valve pin 13 is formed with annular grooves 21 and 22 axially spaced from each other, between which the orifice 19*b* is located. The annular groove 21 is axially spaced from an axial end face 26, a lower end face as viewed in FIG. 1, of the piston portion 13*b* and the annular groove 22 is axially spaced from an opposite end face 25, an upper end face as viewed in FIG. 1, of the piston portion 13*b*. Thus, the inlet 20 of the fluid passage 19 is positioned between the annular grooves 21 and 22 in a spaced relation thereto.

Second and third seals 23 and 24 are received in the annular grooves 21 and 22 on the piston portion 13*b* of the valve pin 13, respectively. The seals 23 and 24 are of a ring shape and made of an elastic material. The seals 23 and 24 thus mounted onto the piston portion 13*b*, are spaced from each other in the axial direction of the valve pin 13. As illustrated in FIG. 1, the seals 23 and 24 are located downwardly spaced from the seal 17. The seal 24 is positioned between the seals 17 and 23. Thus, the seals 17, 23 and 24 are arranged in a spaced relation to each other in the axial direction of the valve pin 13. The seal 23 is located downward the inlet 20 of the fluid passage 19 and in contact with the inner peripheral surface of the valve case 12 that surrounds the central bore 15, as shown in FIG. 1. The seal 23 thus cooperates with the valve case 12 to block fluid communication between inside and outside of the container 11 through the fluid passage 19 and the space between the piston portion 13*b* and the valve case 12, when the valve pin 13 is in a first raised position shown in FIG. 1. The seal 24 is positioned upward the inlet 20 of the fluid passage 19 as shown in FIG. 1, and between the inlet 20 and the pressure introducing passage 18. The seal 24 is in contact with the inner peripheral surface of the valve case 12 that surrounds the central bore 15, and always blocks fluid communication between the pressure introducing passage 18 and the fluid passage 19. With the arrangement of the seal 24, the vapor pressure within the container 11 is prevented from flowing into the bottom of the central bore 15 and the inlet 20 of the fluid passage 19 through the pressure introducing passage 18 and the space between the piston portion 13*b* and the valve case 12.

The vapor pressure within the container 11 is always applied to the entire area of the axial end face 26 of the piston portion 13*b* of the valve pin 13. In a condition that the valve pin 13 is in the first position shown in FIG. 1, the vapor pressure within the container 11 is applied to both the axial end face 26 and the opposite axial end face 25 of the piston portion 13*b* of the valve pin 13. Thus, the axial end face 26 and the opposite axial end face 25 are pressure-bearing surfaces subjected to the same vapor pressure within the container 11. Therefore, a part of the vapor pressure applied to the axial end face 26 is counterbalanced by the vapor pressure applied to the opposite axial end face 25. Concretely, the axial end face 26 is greater than a pressure-bearing area of the opposite axial end face 25 by an area of a cross section of the shaft portion 13*a* that is taken along the line perpendicular to the axis of the valve pin 13. A force represented by the product of the vapor pressure and the difference in area between the axial end faces 25 and 26 acts on the valve pin 13 to urge the valve pin 13 upwardly.

The valve case 12 includes a tapered end portion 28 of the side wall portion of the valve case 12. The tapered end portion 28 cooperates with the seal 23 to establish the fluid communication between inside and outside of the container 11 through the fluid passage 19 and the space between the piston portion 13*b* and the valve case 12, when the valve pin 13 is in a second position shown in FIG. 2. Specifically, the tapered end portion 28 defines a greater-diameter bore portion 27 forming a part of the central bore 15. The greater-diameter bore portion 27 has a gradually increasing diameter and faces to inside of the container 11. The tapered end portion 28 has a sloped surface inclining relative to the axis of the valve pin 13. A clearance is generated between the sloped surface of the tapered end portion 28 and an outer peripheral surface of the seal 23, as the valve pin 13 moves downwardly. The seal 23 is out of the contact with the sloped surface of the tapered end portion 28 of the valve case 12 as shown in FIG. 2, when the valve pin 13 is placed in the second position after moving downwardly by a predetermined amount or more.

An operation of the valve 10 will be explained hereinafter along with the displacement of the valve pin 13 between the first and second positions.

When the nozzle button 14 is in a non-depressed position shown in FIG. 1, the valve pin 13 is urged by the force of the vapor pressure within the container 11 that acts thereon, and placed in the first raised position. In this case, the seals 23 and 24 on the piston portion 13*b* of the valve pin 13 are in contact with the inner peripheral surface of the side wall portion of the valve case 12 and interrupt the fluid communication between the inlet 20 of the fluid passage 19 and inside of the container 11. Thus, the fluid communication between inside and outside of the container 11 through the fluid passage 19 is restrained. The seal 17 is in contact with the shaft portion 13*a* of the valve pin 13 to block the fluid communication between inside and outside the container 11. Therefore, the pressurized fluid within the container 11 is prevented from being discharged and aerosolized therefrom.

When the nozzle button 14 is depressed, the valve pin 13 is moved downwardly and displaced into the second position shown in FIG. 2. In this case, there exists a clearance between the seal 23 and the sloped surface of the tapered end portion 28 of the side wall portion of the valve case 12. With the clearance, the seal 23 is free from the contact with the valve case 12 to allow the fluid communication between the inlet 20 of the fluid passage 19 and inside of the container 11. On the other hand, the seal 24 is kept in contact with the inner peripheral surface of the side wall portion of the valve case 12 and blocking the fluid communication between the pressure introducing passage 18 and the fluid passage 19. Therefore, the fluid communication between inside and outside of the container is established through the fluid passage 19. As a result, the pressurized fluid within the container 11 is permitted to pass through the fluid passage 19 and discharged and aerosolized to outside of the container 11 through the aerosolized outlet of the nozzle button 14. The valve pin 13 is returned to the first position by the force of the vapor pressure within the container 11 in response to release of the nozzle button 14 from the depressed position.

As explained above, the valve 10 of the present invention has the fluid passage 19 formed in the valve pin 13 and controls an amount of the pressurized fluid to be discharged per unit time by suitably adjusting the diameter of the orifice 19*b* of the fluid passage 19. Accordingly, the amount of the pressurized fluid to be discharged per unit time can be extremely less influenced by errors that will be caused in the producing process of the valve 10. As a result, irregularity in the amount of the pressurized fluid to be discharged per unit time can be reduced, so that the valve 10 as a product can provide, a stable amount of the pressurized fluid to be discharged per unit time.

Further, in this embodiment, the diameter of the orifice 19*b* is in the order of 0.1 mm, namely the orifice 19*b* has a size as large as those represented by a unit of 0.1 mm. Since the orifice 19*b* has the large diameter as compared with the conventional art, the orifice 19*b* is prevented from being clogged with the pressurized fluid upon stopping the discharge of the pressurized fluid. Even if there occurs clogging of the orifice 19*b*, the amount of the pressurized fluid to be discharged per unit time can be less influenced. Accordingly, change in amount of the pressurized fluid to be discharged per unit time can be reduced even after duration of use. Thus, the valve 10 can maintain a performance in stably discharging the pressurized fluid for duration of use.

Furthermore, the valve pin 13 is formed with the piston portion 13*b* that has the greater diameter than the shaft portion 13*a* and supports the seal 23 thereon. With this arrangement, a radial thickness of the seal 23 can be determined at such a large value as to completely interrupt the fluid communication between the orifice 19*b* of the fluid passage 19 and inside of the container 11.

In addition, with the provision of the piston portion 13*b* of the valve pin 13, the force caused by the vapor pressure applied to the axial end face 26 is partly counterbalanced by the force caused by the vapor pressure applied to the opposite axial end face 25. Therefore, it is possible to restrain undesirable increase in reaction force that is caused when the valve pin 13 is moved downwardly through the nozzle button 14. Thus, the operation of the valve pin 13 cannot be disturbed by the provision of the piston portion 13*b* having the greater diameter.

Further, since the fluid passage 19 is constituted by the axial hole 19*a* extending in the axial direction of the valve pin 13 and the orifice 19*b* extending in the radial direction thereof, the fluid passage 19 is considerably easily formed in the valve pin 13. Furthermore, the amount of the pressurized fluid to be discharged per unit time can be readily changed by selectively using tools for forming the orifice 19*b*, which have different diameters. Accordingly, it is possible to easily carry out formation and change of design of the fluid passage 19, serving for reducing the producing cost.

INDUSTRIAL APPLICABILITY

As described above, the valve and the inhalator with the valve, of the present invention is useful in reduction of dispersion of an amount of the pressurized fluid to be discharged per unit time every completed product and provision of a stable amount thereof for duration of use. The valve is applicable to apparatus, such as inhalator, sprayer and the like, including a container storing fluid along with pressurized gas as propellant. Further, the inhalator with the valve is generally applicable to inhalators employing fluid medicine and pressurized gas as propellant.

What is claimed is:

1. A valve for an inhalator including a container for storing a pressurized fluid, comprising:

a valve case secured to the container;

a valve pin moveably mounted to said valve case, and said valve pin including an end portion that is exposed to the pressurized fluid within the container, said end portion of said valve pin cooperating with said valve case to define a space therebetween;

a first seal and a second seal that are arranged in a spaced relation in an axial direction of said valve pin, said first seal being mounted onto said end portion of said valve pin; and a fluid passage formed in said valve pin, said fluid passage having an outlet communicating with an outside of the container and an inlet that communicates with said space and is arranged between said first and second seals in a spaced relation thereto;

said valve pin taking a first position where said first seal cooperates with said valve case to block fluid communication between inside and outside of the container through said space and said fluid of the container through said space and said fluid passage and a second position where said first seal cooperate with said valve case to establish fluid communication between inside and outside of the container through said space and said fluid passage;

wherein said valve pin includes a shaft portion and a piston portion, said piston portion having a greater diameter than said shaft portion, said piston portion being disposed on said end portion of said valve pin, wherein said valve case includes a wall defining a generally cylindrical bore in which said piston portion of said valve pin is received, and wherein said wall of said valve case defines a pressure introducing passage through which pressure within the container is introduced into said generally cylindrical bore.

2. A valve as claimed in claim 1, wherein said fluid passage includes an axial hole extending in the axial direction of said valve pin and an orifice extending in a radial direction of said valve pin and connected with said axial hole, said orifice being open to an outer periphery of said end portion of said valve pin and defining said inlet of said fluid passage.

3. A valve as claimed in claim 1, wherein said second seal is arranged in said valve case and cooperates with said shaft portion of said valve pin to constantly block the fluid communication between inside and outside of the container through said space.

4. A valve as claimed in claim 1, wherein said wall of said valve case includes a tapered end portion cooperating with said first seal and defining a greater-diameter bore portion in said generally cylindrical bore, said greater-diameter bore portion having a gradually increasing diameter and being open to an interior of the container.

5. A valve as claimed in claim 1, further comprising a third seal mounted to said piston portion of said valve pin, said third seal being arranged between said inlet of said fluid passage and said pressure introducing passage, said third seal cooperating with said valve case to block fluid communication between said fluid passage and said pressure introducing passage through said space.

6. An inhalator, comprising:

a container having an open end and adapted to contain a pressurized fluid;

a valve case secured to said open end of said container;

a valve pin moveably mounted to said valve case, said valve pin including an end portion that is exposed to the pressurized fluid within said container, said end portion of said valve pin cooperating with said valve case to define a space therebetween;

a first seal and a second seal that are arranged in a spaced relation in an axial direction of said valve pin, said first seal being mounted onto said end portion of said valve pin; and a fluid passage formed in said valve pin, said fluid passage having an outlet communicating with an outside of said container and an inlet that communicates with said space and that is arranged between said first and second seals in a spaced relation thereto;

said valve pin taking a first position where said first seal cooperates with said valve case to block fluid communication between inside and outside of said container through said space and said fluid passage and a second position where said first seal cooperates with said valve case to establish fluid communication between inside and outside of said container through said space and said fluid passage;

wherein said valve pin includes a shaft portion and a piston portion having a greater diameter than said shaft portion, said piston portion being disposed on said end portion of said valve pin, wherein said valve case includes a wall defining a generally cylindrical bore in which said piston portion of said valve pin is received, and wherein said wall of said valve case defines a pressure introducing passage through which pressure within the container is introduced into said generally cylindrical bore.

7. An inhalator as claimed in claim 6, wherein said fluid passage includes an axial hole extending in the axial direction of said valve pin and an orifice extending in a radial direction of said valve pin and connected with said axial hole, said orifice being open to an outer periphery of said end portion of said valve pin and defining said inlet of said fluid passage.

8. An inhalator as claimed in claim 6, wherein said second seal is arranged in said valve case and cooperates with said shaft portion of said valve pin to constantly block the fluid communication between inside and outside of said container through said space.

9. An inhalator as claimed in claim 6, wherein said wall of said valve case includes a tapered end portion cooperating with said first seal and defining a greater-diameter bore portion in said generally cylindrical bore, said greater-diameter bore portion having a gradually increasing diameter and being open to inside of said container.

10. An inhalator as claimed in claim 6, further comprising a third seal mounted to said piston portion of said valve pin, said third seal being arranged between said inlet of said fluid passage and said pressure introducing passage, said third seal cooperating with said valve case to block fluid communication between said fluid passage and said pressure introducing passage through said space.

11. A valve for an inhalator which includes a container for storing a pressurized fluid, comprising:

a valve case secured to the container, said valve case being formed with a first annular groove;

a valve pin moveable between a first position and a second position relative to the valve case, said valve pin being formed with a second annular groove at an end portion thereof, said end portion cooperating with the valve case to define a space therebetween, said end portion being exposed to the pressurized fluid within the container;

a first seal mounted to the second annular groove of the valve pin;

a second seal mounted to the first annular groove of the valve case, said second seal being spaced from the first seal in an axial direction of the valve pin, said second seal cooperating with the valve pin to constantly block fluid communication between an exterior and an interior of the container through the space; and a fluid passage formed in the valve pin, said fluid passage having an outlet that communicates with the exterior of the container and an inlet that communicates with the space and is arranged between said first and second seal in a spaced relation thereto;

said first seal cooperating with the valve case to block the fluid communication between the interior and the exterior of the container through the space and the fluid passage when the valve pin is in the first position, and establish the fluid communication therebetween through the space and the fluid passage when the valve pin is in the second position;

wherein the valve pin includes a shaft portion and a piston portion having a greater diameter than the shaft portion, the piston portion being disposed on the end portion of the valve pin;

wherein the valve case includes a wall defining a generally cylindrical bore in which the piston portion of the valve pin is received; and wherein the wall of the valve case includes a tapered end portion cooperating the first seal and defining a greater-diameter bore portion in the generally cylindrical bore, the greater-diameter bore portion having a gradually increasing diameter and being open to inside of the container.

12. A valve for an inhalator which includes a container for storing a pressurized fluid, comprising:

a valve case secured to the container, said valve case being formed with a first annular groove;

a valve pin moveable between a first position and a second position relative to the valve case, said valve pin being formed with a second annular groove at an end portion thereof, said end portion cooperating with the valve case to define a space therebetween, said end portion being exposed to the pressurized fluid within the container;

a first seal mounted to the second annular groove of the valve pin;

a second seal mounted to the first annular groove of the valve case, said second seal being spaced from the first seal in an axial direction of the valve pin, said second seal cooperating with the valve pin to constantly block fluid communication between an exterior and an interior of the container through the space; and a fluid passage formed in the valve pin, said fluid passage having an outlet that communicates with the exterior of the container and an inlet that communicates with the space and is arranged between said first and second seal in a spaced relation thereto;

said first seal cooperating with the valve case to block the fluid communication between the interior and the exterior of the container through the space and the fluid passage when the valve pin is in the first position, and establish the fluid communication therebetween through the space and the fluid passage when the valve pin is in the second position;

wherein the valve pin includes a shaft portion and a piston portion having a greater diameter than the shaft portion, the piston portion being disposed on the end portion of the valve pin; and wherein the wall of the valve case defines a pressure introducing passage through which pressure within the container is introduced into the generally cylindrical bore.

13. A valve as claimed in claim 12, further comprising a third seal mounted to the piston portion of the valve pin, the third seal being arranged between the inlet of the fluid passage and the pressure introducing passage, the third seal cooperating with the valve case to block fluid communication between the fluid passage and the pressure introducing passage through the space.

14. An inhalator comprising:

a container having an open end and adapted to contain a pressurized fluid;

a valve case secured to the open end of the container, the valve case being formed with a first annular groove;

a valve pin moveable between a first position and a second position relative to the valve case, the valve pin being formed with a second annular groove at an end portion thereof, the end portion cooperating with the valve case to define a space therebetween, the end portion being exposed to the pressurized fluid within the container;

a first seal mounted to the second annular groove of the valve pin;

a second seal mounted to the first annular groove of the valve case, the second seal being spaced from the first seal in an axial direction of the valve pin, the second seal cooperating with the valve pin to constantly block fluid communication between inside and outside of the container through the space; and a fluid passage formed in the valve pin, the fluid passage having an outlet communicating with an exterior of the container and an inlet that communicates with the space and that is arranged between the first and second seal in a spaced relation thereto;

the first seal cooperating with the valve case to block the fluid communication between the interior and the exterior of the container through the space and the fluid passage when the valve pin is in the first position, and establish the fluid communication therebetween through the space and the fluid passage when the valve pin is in the second position;

wherein the valve pin includes a shaft portion and a piston portion having a greater diameter than the shaft portion, the piston portion being disposed on the end portion of the valve pin;

wherein the second seal cooperates with the shaft portion of the valve pin;

wherein the valve case includes a wall defining a generally cylindrical bore in which the piston portion of the valve pin is received; and wherein the wall of the valve case includes a tapered end portion cooperating with the first seal and defining a greater-diameter bore portion in the generally cylindrical bore, the greater-diameter bore portion having a gradually increasing diameter and being open to the interior of the container.

15. An inhalator comprising:

a container having an open end and adapted to contain a pressurized fluid;

a valve case secured to the open end of the container, the valve case being formed with a first annular groove;

a valve pin moveable between a first position and a second position relative to the valve case, the valve pin being formed with a second annular groove at an end portion thereof, the end portion cooperating with the valve case to define a space therebetween, the end portion being exposed to the pressurized fluid within the container;

a first seal mounted to the second annular groove of the valve pin;

a second seal mounted to the first annular groove of the valve case, the second seal being spaced from the first seal in an axial direction of the valve pin, the second seal cooperating with the valve pin to constantly block fluid communication between inside and outside of the container through the space; and a fluid passage formed in the valve pin, the fluid passage having an outlet communicating with an exterior of the container and an inlet that communicates with the space and that is arranged between the first and second seal in a spaced relation thereto;

the first seal cooperating with the valve case to block the fluid communication between the interior and the exterior of the container through the space and the fluid passage when the valve pin is in the first position, and establish the fluid communication therebetween through the space and the fluid passage when the valve pin is in the second position;

wherein the valve pin includes a shaft portion and a piston portion having a greater diameter than the shaft portion, the piston portion being disposed on the end portion of the valve pin;

wherein the second seal cooperates with the shaft portion of the valve pin;

wherein the valve case includes a wall defining a generally cylindrical bore in which the piston portion of the valve pin is received; and wherein the wall of the valve case defines a pressure introducing passage through which pressure within the container is introduced into the generally cylindrical bore.

16. An inhalator as claimed in claim 15, further comprising a third seal mounted to the piston portion of the valve pin, the third seal being arranged between the inlet of the fluid passage and the pressure introducing passage, the third seal cooperating with the valve case to block fluid communication between the fluid passage and the pressure introducing passage through the space.

* * * * *